US009494121B2

(12) United States Patent
Felton

(10) Patent No.: US 9,494,121 B2
(45) Date of Patent: Nov. 15, 2016

(54) FUEL PUMP ASSEMBLY

(71) Applicant: DELPHI INTERNATIONAL OPERATIONS LUXEMBOURG, S.A.R.L., Bascharage (LU)

(72) Inventor: George Nicholas Felton, Gillingham (GB)

(73) Assignee: Delphi International Operations Luxembourg, S.A.R.L., Luxembourg (LU)

( * ) Notice: Subject to any disclaimer, the term of this patent is extended or adjusted under 35 U.S.C. 154(b) by 71 days.

(21) Appl. No.: 14/372,227

(22) PCT Filed: Jan. 31, 2013

(86) PCT No.: PCT/EP2013/051943
§ 371 (c)(1),
(2) Date: Jul. 15, 2014

(87) PCT Pub. No.: WO2013/117485
PCT Pub. Date: Aug. 15, 2013

(65) Prior Publication Data

US 2014/0366849 A1 Dec. 18, 2014

(30) Foreign Application Priority Data

Feb. 9, 2012 (GB) ..... 1202221.6

(51) Int. Cl.
*F02M 69/02* (2006.01)
*F02M 59/10* (2006.01)

(52) U.S. Cl.
CPC ..... *F02M 69/02* (2013.01); *F02M 59/102* (2013.01)

(58) Field of Classification Search
CPC ..... F02M 59/102; F02M 57/023; F02M 41/1416; F02M 59/08; F02M 45/06;
(Continued)

(56) References Cited

U.S. PATENT DOCUMENTS 5,215,060 A 6/1993 Klopfer et al.
5,443,048 A * 8/1995 Nicol ..... F02M 41/1405 123/198 D (Continued)

FOREIGN PATENT DOCUMENTS

DE 10 2006 045933 A1 4/2008
EP 0 778 413 B1 8/2001

(Continued)

OTHER PUBLICATIONS

International Search Report dated Apr. 4, 2013.

*Primary Examiner* — Stephen K Cronin
*Assistant Examiner* — Long T Tran
(74) *Attorney, Agent, or Firm* — Joshua M. Haines

(57) ABSTRACT

A fuel pump assembly comprises a pumping plunger for pressurizing fuel within a pumping chamber during a plunger pumping stroke; and a cam follower arrangement for imparting drive to the pumping plunger including a cam follower member which cooperates with the pumping plunger. The cam follower arrangement is biased into engagement with a cam drive while a degree of relative movement along the plunger axis is permitted between the cam follower member and the pumping plunger. At least one of the pumping plunger and the cam follower member includes a surface provided with a feature which defines together with a facing surface of the other of the pumping plunger and the cam follower member, a cushioning volume therebetween for receiving fluid to provide a cushioning effect as the pumping plunger and the cam follower member move into contact with one another, in use. The feature includes a flat central portion and an annular region which is conical in form and which is angled relative to the facing surface.

13 Claims, 2 Drawing Sheets

(58) Field of Classification Search
CPC ..... F02M 39/005; F02M 41/1405; F02M 59/44; F02M 69/02; F02M 41/042; F02M 59/027; F02M 43/02; F02M 59/00
USPC ..... 123/445–500; 417/462, 53, 273, 238, 417/470
See application file for complete search history.

(56) References Cited

U.S. PATENT DOCUMENTS

| | | | | |
|---|---|---|---|---|
| 5,823,091 | A * | 10/1998 | Collingborn | F04B 1/053 417/238 |
| 6,854,962 | B2 * | 2/2005 | Spoolstra | F02M 45/06 123/458 |
| 6,991,438 | B2 | 1/2006 | Blessing et al. | |
| 7,048,516 | B2 * | 5/2006 | Maier | F02M 55/04 417/273 |
| 7,509,947 | B2 * | 3/2009 | Tansug | F02M 59/102 123/446 |
| 8,181,564 | B2 | 5/2012 | Rosu et al. | |
| 2004/0247470 | A1 * | 12/2004 | Maier | F02M 55/04 417/462 |
| 2006/0159572 | A1 * | 7/2006 | Higgins | F02M 41/1405 417/462 |
| 2010/0037865 | A1 | 2/2010 | Fuchs | |
| 2012/0125277 | A1 * | 5/2012 | Chambonneau | F16H 53/06 123/90.48 |
| 2012/0145131 | A1 * | 6/2012 | Yoshimura | F02M 37/06 123/495 |

FOREIGN PATENT DOCUMENTS

| | | | |
|---|---|---|---|
| EP | 1 347 172 | A2 | 9/2003 |
| EP | 2 177 746 | A1 | 4/2010 |
| JP | 5-296118 | | 11/1993 |
| JP | 2001-41129 | A | 2/2001 |
| JP | 2009-97508 | A | 5/2009 |
| WO | 2010/139663 | A1 | 12/2010 |

* cited by examiner

FUEL PUMP ASSEMBLY

CROSS REFERENCE TO RELATED APPLICATIONS

This application is a national stage application under 35 U.S.C. 371 of PCT Application No. PCT/EP2013/051943 having an international filing date of 31 Jan. 2013, which designated the United States, which PCT application claimed the benefit of Great Britain Patent Application No. 1202221.6 filed 9 Feb. 2012, the entire disclosure of each of which are hereby incorporated herein by reference.

TECHNICAL FIELD

The invention relates to a fuel pump assembly of the type suitable for use in common rail fuel injection systems of internal combustion engines. In particular, the invention relates to a fuel pump assembly having an improved plunger/cam follower arrangement.

BACKGROUND TO THE INVENTION

In a known fuel pump assembly a pumping plunger is driven for reciprocal movement within a bore provided in a pump housing by means of a cam drive arrangement including an engine-driven cam. A cam follower cooperates with the cam, and in turn a foot of the plunger cooperates with the cam follower. Fuel from a low pressure fuel source is delivered to a pumping chamber via an inlet metering valve which controls the rate of flow of fuel into the pumping chamber. As the plunger reciprocates within the bore fuel within the pumping chamber is pressurised. An outlet valve controls the delivery of pressurised fuel to the downstream common rail.

In one type of unit pump arrangement the pump assembly includes a plurality of separate pumps units, each with its own pumping chamber, inlet valve and outlet valve. A cam follower is provided for each of the pump units, each cam follower being cooperable with a respective cam that is carried on a drive shaft common to the other cams.

In other arrangements, such as described in EP 0778413 B, the plungers are arranged as opposed pairs and are driven inwardly by a radially outer cam ring to perform a pumping stroke during which fuel within a pumping chamber, arranged between opposed ones of the plungers, is pressurised. Each plunger has an associated cam follower which cooperates with the cam ring, with an inlet metering valve and an outlet valve being provided for each pair of the plungers. As the cam followers ride over the cam surface the plunger pairs are driven inwardly to reduce the volume of the pumping chamber and, hence, increase fuel pressure within the pumping chamber.

Typically the inlet metering valve takes the form of a variable orifice which controls the flow of fuel into the pumping chamber. The volume of fuel to be pressurised in any given plunger stroke will usually be less than the maximum swept volume of the associated pumping chamber. Particularly in pump arrangements for which a degree of relative movement is permitted between each plunger and its cam follower this can give rise to an impact load between the foot of each plunger and its cam follower when they come into contact during the pumping stroke. The impact load can lead to wear at the interface between the plunger and its cam follower and may give rise to mechanical noise and other undesirable side effects.

It is with a view to addressing or mitigating the aforementioned problem that the present invention provides an improved fuel pump assembly and plunger/cam follower arrangement.

STATEMENTS OF INVENTION

According to a first aspect of the present invention, there is provided a fuel pump assembly for use in an internal combustion engine. The fuel pump assembly comprises a pumping plunger for pressurising fuel within a pumping chamber during a plunger pumping stroke, and a cam follower arrangement for imparting drive to the pumping plunger. The cam arrangement includes a cam follower member which cooperates with the pumping plunger. The cam follower arrangement is biased into engagement with a cam drive whilst a degree of relative movement along the plunger axis is permitted between the cam follower member and the pumping plunger. At least one of the pumping plunger and the cam follower member includes a surface provided with a feature which defines together with a facing surface of the other of the pumping plunger and the cam follower member, a cushioning volume therebetween for receiving fluid to provide a cushioning effect as the pumping plunger (16) and the cam follower member (18) move into contact with one another, in use. The feature includes a flat central portion and an annular region, which is conical in form and which is angled relative to the facing surface. The annular region may surround the flat central portion (i.e. the flat central portion is bounded entirely by the annular region).

The cam follower member is typically a shoe or a tappet which imparts drive to the pumping plunger.

It is a benefit of the invention that, as the pumping plunger and cam follower member are brought into contact with one another, the impact load between the pumping plunger and the follower member is reduced by virtue of the cushioning volume for fluid that exists at the interface between the parts. The impact load occurs in particular when the pumping chamber is only partially filled. The cam follower member and the plunger are caused to separate during a return stroke of the plunger before making contact again part-way through the pumping stroke.

In one embodiment, only the pumping plunger includes the feature to define the cushioning volume together with the cam follower member.

For example, an end surface of the pumping plunger may include the flat central portion and the annular region. In this case the annular region may be angled relative to the facing surface of the cam follower member.

The angled surfaces of the pumping plunger and the cam follower member may preferably define therebetween an included angle of between 0.1 and 1.5 degrees. In a more preferred embodiment the included angle is between 0.25 and 1.25 degrees.

The optimum angle will differ from application to application and will be particularly dependent on the lubricant used and on the peak impact velocity of the plunger and the cam follower member.

In another embodiment the surface of the pumping plunger is flat and only the cam follower member includes the feature to define the cushioning volume together with the pumping plunger.

For example, in this embodiment the surface of the cam follower member may be angled relative to the facing surface of the pumping plunger to define therebetween an included angle of between 0.1 and 1.5 degrees and more preferably of between 0.25 and 1.25 degrees.

In a still further embodiment a surface of both the pumping plunger and the cam follower member may include a feature to define the cushioning volume therebetween.

By way of example, the cushioning volume may be of annular form.

In one particular embodiment, the fuel pump assembly may include at least first and second opposed pumping plungers which are reciprocal within a common bore provided in a pump housing to cause pressurisation of fuel within a common pumping chamber, wherein each pumping plunger has an associated cam follower member which, together with the associated pumping plunger, defines a cushioning volume therebetween which receives fluid, in use, to provide a cushioning effect as the pumping plunger and said associated follower member come into contact with one another.

The or each cam follower arrangement may typically include a cam follower member in the form of a shoe or a tappet.

Preferably, the cam follower arrangement is biased into engagement with the cam drive by means of a return spring. As the plunger is not biased towards the cam drive, a degree of relatively movement is permitted between the plunger and the cam follower arrangement along the plunger axis.

BRIEF DESCRIPTION OF THE DRAWINGS

The invention will now be described, by way of example only, with reference to the following figures in which.

DETAILED DESCRIPTION OF PREFERRED EMBODIMENTS

Figure 1:
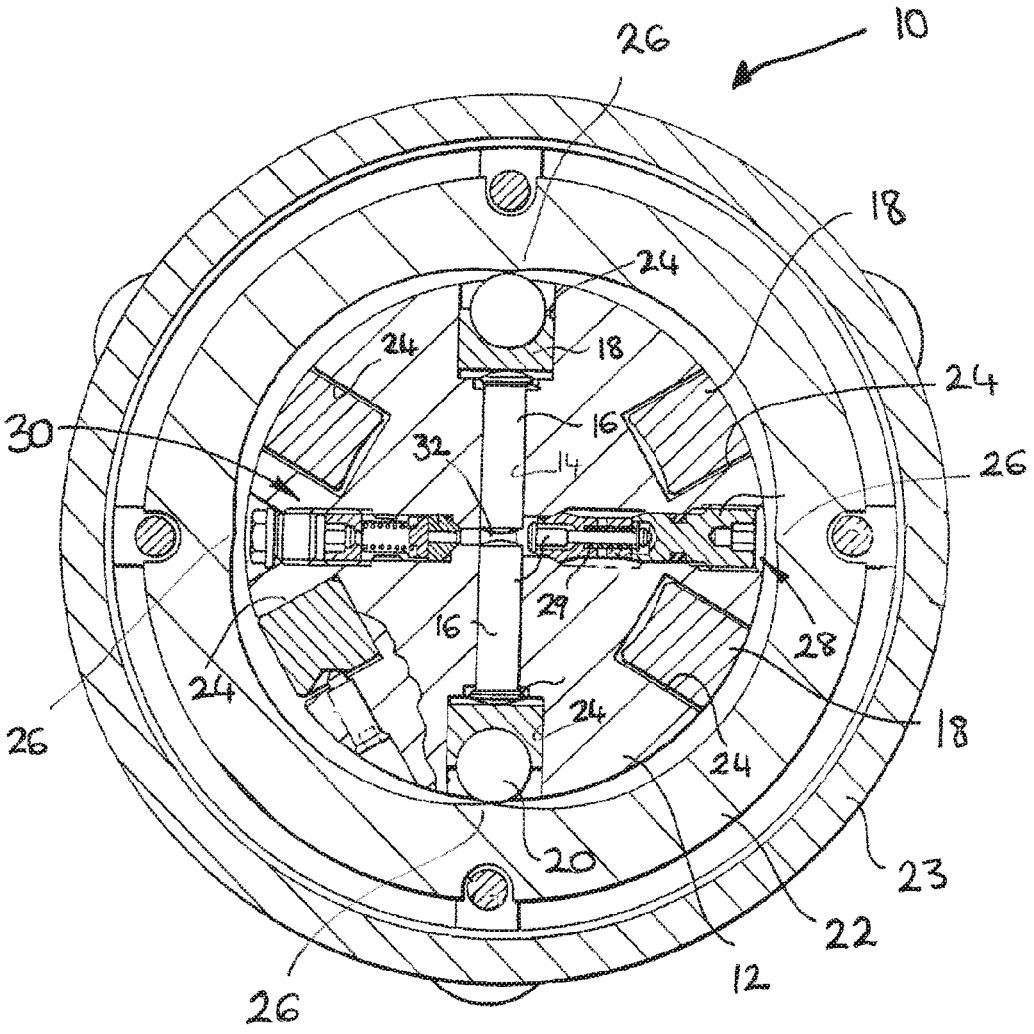
FIG. 1 is a sectional view of a fuel pump assembly known in the prior art and to which the present invention may be applied.

FIG. 1 illustrates a fuel pump assembly 10 that is known in the prior art and to which the present invention may be applied to achieve a beneficial effect. The fuel pump assembly 10 has a central pump body 12 provided with three through bores 14 (only one of which is visible in the section shown). The through bores 14 are axially spaced from one another and two plungers 16 are arranged coaxially in each bore. Each plunger of the pair reciprocal within its through bore 14 along a common axis under the influence of an associated cam follower arrangement.

Each cam follower arrangement includes a cam follower in the form of a shoe 18 and an associated roller 20. The outer end of each plunger 16 is arranged to engage with the shoe 18, which therefore cooperates directly with the plunger 16, as will be described in further detail below. The associated roller 20 cooperates directly with a rotary cam ring 22 which is supported within an outer housing 23 by means of bearings (not shown). Six equi-angularly spaced grooves 24 are provided in the pump body 12, each for receiving a respective one of the shoe and roller arrangements 18, 20. The provision of the grooves 24 serves to maintain alignment of the shoe and roller arrangements 18, 20 and restricts angular movement thereof, whilst permitting axial movement along the direction of the respective plunger axis.

Each of the shoe and roller arrangements 18, 20 is biased into engagement with the surface of the cam ring 22 by means of an associated return spring (not shown in FIG. 1). Also not visible in FIG. 1, the internal surface of the cam ring 22 includes four equi-angularly spaced cam lobes 26. The cam ring 22 is connected to a drive shaft which is arranged to be driven at a speed associated with the engine speed.

Each of the through bores 16 is connected through a respective inlet non-return valve 28 to an inlet port (not shown) for receiving fuel at relatively low pressure from a feed pump (also not shown). Each through bore 16 is also connected to a respective outlet valve 30 which connects with an outlet port (not shown) of the pump assembly. The outlet port connects with a passage to a common rail or other accumulator volume for receiving pressurised fuel and from where fuel is delivered to the downstream fuel injectors of the engine.

Each through bore 16 defines, together with the ends of its associated opposed plunger pair, a pumping chamber 32 into which relatively low pressure fuel is delivered through the inlet non-return valve 28 and from where pressurised fuel is delivered through the outlet valve 30. The inlet valve 28 is hydraulically-operable and is typically spring biased into a closed position by means of an inlet valve spring 29. When the inlet valve is in the closed position, the flow of fuel into the associated pumping chamber 32 is prevented.

The following description relates to the pumping cycle of one pair of pumping plungers. The cycle of movement for each plunger can generally be considered to consist of a pumping stroke in which the plunger is driven inwardly within the plunger bore to reduce the volume of the pumping chamber, and during which phase pressurised fuel is delivered through the outlet valve to the common rail, and a return stroke in which the plunger is driven outwardly from the plunger bore to increase the volume of the pumping chamber, and during which phase fuel fills the pumping chamber through the inlet valve.

An appropriate quantity of fuel from the feed pump is supplied through the inlet port of the pump body 12 to the pumping chamber 32. With the plungers 16 at their innermost positions within the bore 14, rotation of the cam ring 22 results in the rollers 20 associated with these plungers 16 riding down the trailing flanks of the cam lobes 26, with the shoes 18 and rollers 20 being biased outwardly by the return springs. The fuel supplied through the inlet port results in fuel pressure acting on the inlet valve 28 causing it to open against the spring force. As fuel enters the pumping chamber 32 through the open inlet valve 28, the opposed plungers 16 are pushed apart (i.e. outwardly within the through bore) with their associated shoes 18. If the pumping chamber 32 is only partially filled, so that only a proportion of the maximum filling volume of fuel is delivered through the inlet valve 28, the plungers 16 will not be moved outwardly from the bore 14 to the full extent. However, because the shoes 18 are biased into engagement with the cam ring 22, a degree of separation therefore opens up between each plunger 16 and its shoe 18 in circumstances in which the pumping chamber 32 is not fully filled and the plungers 16 are not urged fully outwardly in the through bore 14.

Continued rotation of the cam ring 22 results in the next of the cam lobes engaging the shoe and roller arrangements 18, 20 so as to push the shoe and roller arrangements inwardly, commencing the pumping stroke. Because of the separation between the shoe 18 and its associated plunger 16, the parts are only brought into contact at a point part-way through the pumping stroke. This gives rise to an impact load between each shoe 18 and its plunger 16 as the parts are brought into contact. This is a particular problem in the fuel pump of the type shown in FIG. 1 because the plungers are not coupled to their respective shoe and roller arrangements by means of a spring, as in some pump arrangements, so that a degree of play is permitted between the plunger 16 and the shoe and roller arrangement 18, 20. Furthermore, when the shoe moves inwardly to meet the plunger 16 it is moving at relatively high velocity and, as a result of the impact load, there is increased wear between the cooperating parts 16, 18 and, in addition, undesirable mechanical noise.

When the shoes 18 do make contact with their associated plungers 16, subsequent inward movement of the plungers 16, as driven by the shoe and roller arrangements 18, 20, pressurises the fuel within the pumping chamber 32 such that the inlet valve 28 closes (the pressure difference across the inlet valve, together with the spring force, is sufficient to close the valve). Fuel within the pumping chamber 32 is pressurised, and the pressurised fuel is pumped out of the outlet valve 30 once the pressure reaches a level that is sufficient to cause the outlet valve 30 to open.

The other pairs of plungers 16 function in the same manner as described above, but are out of phase with the above-described plungers with the result that for each complete revolution of the cam ring there are twelve pulses of fuel supplied to the outlet port to the common rail.

Figure 2:
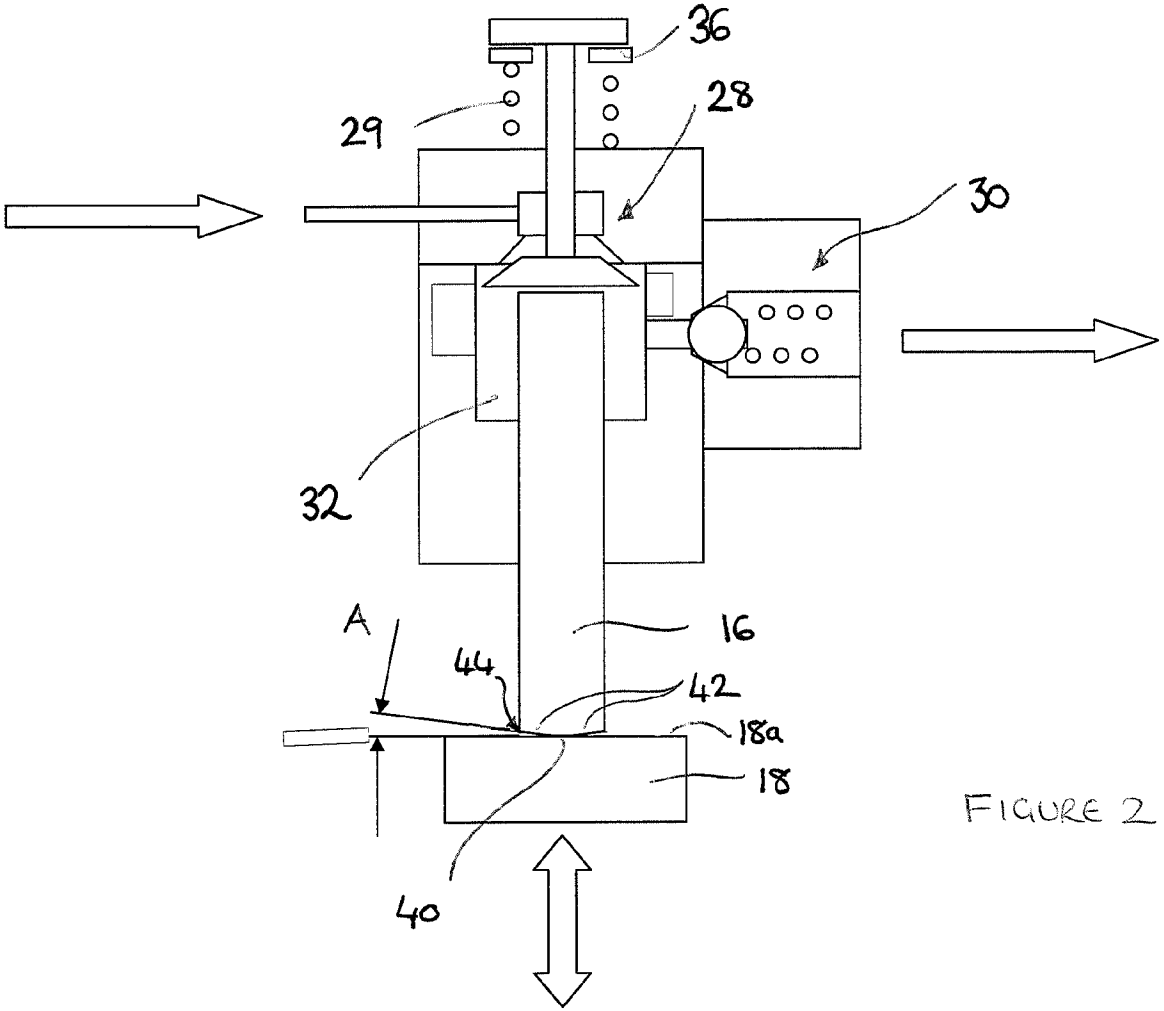
FIG. 2 is a schematic diagram of a pump unit of an embodiment of the invention which may be incorporated into the fuel pump assembly in FIG. 1.

FIG. 1 is an example of a pump assembly in which each plunger 16 and its cam follower 18 are permitted to move relative to one another, along the plunger axis, because the shoe 18 is biased into engagement with the cam ring 22 but the plunger 16 is not biased into engagement with the shoe 18. FIG. 2 is a schematic view of a pump unit of a fuel pump assembly which has similar features to those described with reference to FIG. 1, and again in which the plunger 16 and the cam follower 18 are able to move relative to one another along the plunger axis. As described previously, the pumping chamber 32 has in inlet valve 28 and an outlet valve 30 for controlling the flow into and out of the pumping chamber 32, respectively. One difference between the pump assembly in FIG. 1 and that in FIG. 2 is that the pumping chamber 32 in FIG. 2 is associated with only a single pumping plunger element 16, rather than a pair of opposed plungers as in FIG. 1.

A shim 36 on the inlet valve 28 sets the biasing force of the valve spring 29 so that the pressure at which the inlet valve opens can be varied, depending on size of the shim 36.

An additional feature of the pump unit in FIG. 2 compared to that in FIG. 1 is that the plunger 16 has a surface at its end remote from the pumping chamber 32 which has a central flat zone, or flat central portion, identified as 40, and an annular zone or annular region 42 which extends from the central flat zone 40 to the outer circumference of the pumping plunger 16. The annular region 42 surrounds the flat central portion 40 and has a substantially conical shape. In this arrangement, the surface 18*a* of the shoe 18 acts as a facing surface. The surface 18*a* is flat and the annular zone 42 of the plunger 16 is angled relative to the flat shoe surface 18*a* so as to define, together with the flat shoe surface 18*a*, an included angle A of between 0.25 and 1.25 degrees. This included angle A extends around the full circumference of the pumping plunger 16 and defines, together with the flat shoe surface 18*a*, an annular cushioning volume 44 at the plunger/shoe interface.

In use, lubricating oil or fuel in the cushioning volume 44 serves to cushion the impact of the shoe 18 as it is moved inwardly to meet with the pumping plunger 16 at the start of the pumping stroke. This cushioning effect provides the benefit that wear of the cooperating parts 16, 18 is reduced, and so too are undesirable noise effects which arise as the parts come together.

In an alternative embodiment (not shown) the shaping feature may be applied to the surface 18*a* of the shoe instead of the plunger 16, with the cushioning volume taking the same form as that shown in FIG. 2. In this arrangement, the plunger 16 includes the facing surface which is substantially flat. A central portion of the cam follower surface is flat, with an annular surface, radially outward of the central portion, which is substantially conical in shape. The conical surface is angled so as to define an included angle with the flat surface of the plunger in the range of between 0.25 and 1.25 degrees. Again, the cushioning volume defined between the two parts 16, 18 serves to provide a cushioning effect as the parts 16, 18 come together during the pumping stroke, which is a particular concern when there is only partial filling of the pumping chamber 32.

In a further alternative embodiment the shaping feature may be applied to both the plunger 16 and the shoe 18 so to define the cushioning volume.

It will be appreciated that the shaping of the plunger 16 and/or of the surface 18*a* of the shoe 18 need not be such as to define a cushioning volume of the form described previously. For example, the surfaces of the parts 16, 18 may be shaped in a curved manner whilst still defining a sufficient volume for lubricant to provide an adequate cushioning effect as the plunger 16 and cam follower 18 come together, in use.

It will be further appreciated that the invention differs from the known principle of shaping a plunger so as to have a radius form on its outer periphery so as to minimise edge damage, in use. Such a radius form does not provide a cushioning volume for fuel or lubricating oil which is adequate to provide a cushioning effect at the plunger/follower interface to reduce the problem of wear.

Several further variations and modifications not explicitly described above are also possible without departing from the scope of the invention as described in the appended claims.

The invention claimed is:

1. A fuel pump assembly for use in an internal combustion engine, the fuel pump assembly comprising:

a pumping plunger for pressurising fuel within a pumping chamber during a plunger pumping stroke; and a cam follower arrangement for imparting drive to the pumping plunger including a cam follower member which cooperates with the pumping plunger, the cam follower arrangement being biased into engagement with a cam drive whilst a degree of relative movement along the plunger axis is permitted between the cam follower member and the pumping plunger;

characterised in that at least one of the pumping plunger and the cam follower member includes a surface provided with a feature which defines together with a facing surface of the other of the pumping plunger and the cam follower member, a cushioning volume therebetween for receiving fluid to provide a cushioning effect as the pumping plunger and the cam follower member move into contact with one another, in use, wherein the feature includes a flat central portion and an annular region, which is conical in form and which is angled relative to the facing surface.

2. The fuel pump assembly as claimed in claim 1, wherein only the pumping plunger includes the feature to define the cushioning volume together with the cam follower member.

3. The fuel pump assembly as claimed in claim 2, wherein an end surface of the pumping plunger includes the flat central portion and the annular region.

4. The fuel pump assembly as claimed in claim 3, wherein the annular region is angled relative to the surface of the cam follower member.

5. The fuel pump assembly as claimed in claim 4, wherein the annular region of the pumping plunger and the surface of the cam follower member define therebetween an included angle of between 0.1 and 1.5 degrees.

6. The fuel pump assembly as claimed in claim 5, wherein the included angle is between 0.25 and 1.25 degrees.

7. The fuel pump assembly as claimed in claim 1, wherein only the cam follower member includes the feature to define the cushioning volume together with the facing surface of the pumping plunger.

8. The fuel pump assembly as claimed in claim 7, wherein the surface of the cam follower member includes an annular region that is angled relative to the flat surface of the pumping plunger to define therebetween an included angle of between 0.1 and 1.5 degrees.

9. The fuel pump assembly as claimed in claim 8, wherein the included angle is between 0.25 and 1.25 degrees.

10. The fuel pump assembly as claimed in claim 1, wherein a surface of both the pumping plunger and the cam follower member includes a feature to define the cushioning volume between the pumping plunger and the cam follower member.

11. A fuel pump assembly as claimed in claim 1, comprising at least first and second opposed pumping plungers which are reciprocal within a common bore provided in a pump housing to cause pressurisation of fuel within a common pumping chamber, wherein each pumping plunger has an associated cam follower member which, together with the associated pumping plunger, defines a cushioning volume therebetween which receives fluid, in use, to provide a cushioning effect as the pumping plunger and said associated follower member come into contact with one another.

12. The fuel pump assembly as claimed in claim 1, wherein the cam follower arrangement includes a cam follower member in the form of a shoe or a tappet.

13. The fuel pump assembly as claimed in claim 1, wherein the cam follower arrangement is biased into engagement with the cam drive by means of a return spring.

* * * * *